US006132780A

United States Patent [19]

Archibald et al.

[11] Patent Number: 6,132,780

[45] Date of Patent: Oct. 17, 2000

[54] CONTAINER FOR STORING FINE PARTICLES

[75] Inventors: William E. Archibald, Maple Grove; Rodney K. Gwiazdon, Minneapolis; George A. Tuszkiewicz, Plymouth, all of Minn.

[73] Assignee: General Mills, Inc., Minneapolis, Minn.

[21] Appl. No.: 09/169,428

[22] Filed: Oct. 9, 1998

[51] Int. Cl.[7] ..... A23B 5/00

[52] U.S. Cl. ..... 426/106; 426/106; 426/115; 426/118; 426/127; 426/394; 383/45; 383/48; 383/61; 383/103

[58] Field of Search ..... 426/106, 115, 426/118, 123, 127, 394, 410, 415; 383/45, 48, 61, 63, 103, 32

[56] References Cited

U.S. PATENT DOCUMENTS

| | | | |
|---|---|---|---|
| 3,302,859 | 2/1967 | Perry . | |
| 3,827,472 | 8/1974 | Uramoto | 383/204 |
| 3,909,582 | 9/1975 | Bowen | 219/121 |
| 4,085,851 | 4/1978 | Young | 206/554 |
| 4,310,118 | 1/1982 | Kisida et al. | 383/102 |
| 4,336,293 | 6/1982 | Eiden | 428/143 |
| 4,421,805 | 12/1983 | Prader | 428/35.2 |
| 4,560,598 | 12/1985 | Cowan | 428/35 |
| 4,672,684 | 6/1987 | Barnes et al. . | |
| 4,743,123 | 5/1988 | Legters et al. . | |
| 4,834,554 | 5/1989 | Stetler, Jr. et al. | 383/100 |
| 4,925,316 | 5/1990 | Van Erden et al. | 383/61 |
| 5,059,036 | 10/1991 | Richison et al. | 383/61 |
| 5,158,499 | 10/1992 | Guckenberger . | |
| 5,228,215 | 7/1993 | Bayer | 36/7.7 |
| 5,229,180 | 7/1993 | Littmann | 428/43 |
| 5,314,702 | 5/1994 | Lewandowski et al. . | |
| 5,492,705 | 2/1996 | Porchia et al. | 426/106 |
| 5,590,777 | 1/1997 | Weiss et al. . | |
| 5,630,308 | 5/1997 | Guckenberger . | |

FOREIGN PATENT DOCUMENTS

| | | |
|---|---|---|
| 0524539 | 1/1993 | European Pat. Off. . |
| 1534230 | 7/1968 | France . |
| 291658 | 6/1928 | United Kingdom . |
| 926198 | 5/1963 | United Kingdom . |
| 1401713 | 7/1975 | United Kingdom . |
| 9322207 | 11/1993 | WIPO . |

OTHER PUBLICATIONS

Mitsui Toatsu Chem., Inc., Jan. 1990, Patent Abstracts of Japan, vol. 14, No. 188.

Toyobo Co. Ltd., Aug. 1990, Patent Abstracts of Japan, vol. 14, No. 495.

*Primary Examiner*—Milton Cano
*Assistant Examiner*—Sherry A. Dauerman
*Attorney, Agent, or Firm*—John A. O'Toole; Douglas J. Taylor; Alan D. Kamrath

[57] ABSTRACT

A container is used to store fine particles such as bakery flour in a sealed packaging, wherein air in the container, such as air entrapped during filling, can be expelled through compression without loss of fine particles. The container includes a main body forming a pouch which terminates in a principal opening and is fabricated from an imperforate flexible material such as clear plastic film. A sealing mechanism is attached to the pouch for sealing the pouch, and a multiplicity of microscopic pores extend through the flexible material. Each pore has a dimension ranging from 10 to 150 μm sufficient to permit air to exit through an exit port, but to prevent the fine particles from escaping through the pores. At least a portion of the pouch material has an anti-slip surface with an external coefficient of friction ranging from about 0.4 to 0.5.

46 Claims, 4 Drawing Sheets

CONTAINER FOR STORING FINE PARTICLES

FIELD OF THE INVENTION

The present invention relates to sealed containers. More specifically, the present invention relates to containers such as plastic bags for storing fine particles such as flour.

BACKGROUND OF THE INVENTION

A variety of fine particle dry powders such as baking products (e.g., flour, baking powder, baking soda, and powdered sugar) are packaged in paper or cardboard containers. Paper and paperboard containers permit the above products to be packaged with a lower content of air than would occur with different containers such as plastic bags. Such containers are highly porous and/or are self venting. The above baking products are not packed in plastic bags because plastic bag containers trap air that is difficult to evacuate from the plastic bag without evacuating a portion of the baking product in the plastic bag at the same time.

Conventional paperboard and paper containers, however, have numerous deficiencies. For example, the traditional paper container for flour can be damaged or infiltrated by numerous environmental factors. The paper tends to absorb moisture that contacts the paper. The moist paper becomes a breeding ground for mold and mildew that can damage the flour. The moisture also causes the paper fibers to expand and weaken, making it easier for the paper container to tear open. The paper container is also susceptible to insect infestation. Numerous types of insects will easily chew completely through the paper. In addition, because of the porous nature of paper, various odors and particles can pass through the paper resulting in a less fresh flour product. The porous nature of the paper also permits moisture to migrate out from the flour product to outside the paper container. This is an especially acute problem when flour is stored in an environment having a low humidity or dew point level. Flour normally has a moisture content of about 14%. In order to compensate for the expected loss of moisture, flour producers actually overfill the paper container to ensure that the product still weighs the amount listed on the packaging after being exposed to a drier environment and losing a certain amount of moisture content. Although only a small amount of overfill is required, the cost to the manufacturer is very significant when you consider the millions of tons of flour that is packaged and sold in the world. Moreover, environmental desiccation can adversely affect the flour's baking properties thereby undesirably leading to a consumer perception of low or poor flour product quality.

The paper containers are also not desirable from a shipping standpoint. When the paper container is filled with flour, the flour becomes aerated, taking up a greater volume of space. The additional space taken up by the aerated flour costs money. In addition, the general rectangular/cylindrical shape of the flour container causes problems with stacking and moving. Complicating the stacking problem is the uneven distribution of flour within the paper container. For example, a first paper container of flour is stacked on top of a second paper container of flour. The weight of the first container causes a downward, compressive force on the second paper container of flour. The air in the second paper container, however, cannot completely escape from the sealed paper container. The result is that the second paper container becomes an unstable, bulging foundation for the first paper container. The problem is exacerbated when a third paper container of flour is stacked on top of the first paper container of flour, creating additional downward force on the second paper container. Unstable stacks of flour containers can be extremely dangerous during shipping. Shifting loads can tip over tractor trailer trucks or fall on top of workers.

Conventional paper flour containers are also not desirable for consumer use. Paper containers are not resealable, thus, the consumer must place the contents into another container in order to prevent the contents from spilling, absorbing moisture or bug infestation. Opening paper containers of flour can also be messy. The conventional method of sealing a paper container involves gluing or seaming a series of folds at the top and bottom of the container. During the sealing process, flour becomes caught between the various folds. When the paper container is opened at the top, the flour caught in the folds, spills onto the counter. Also, such paper flour containers lack an easy-to-open feature. In addition, the shape of the paper container is not generally conducive to baking. Specifically, the tall cylindrical shape is not stable and tends to fall over easily. Moreover, the top end of the container that is opened to access the flour usually folds back onto itself, making entry and removal of a scoop difficult. The shape of the paper container is also a difficult shape to handle with only one hand. The paper container also makes it nearly impossible to tell how much flour is left in the paper container without actually having to look inside the container.

The conventional paper flour container is also not economically efficient to the consumer. Flour becomes trapped in the bottom folds inside the paper container, depriving a consumer of some of the flour product purchased. In addition, similar to the problem faced by the shipper, the consumer has difficulties stacking paper containers of flour. Even if the consumer transfers the flour in the paper container to a plastic bag, the flour cannot be stacked because the air trapped in the plastic bag is difficult to evacuate out of the plastic bag without evacuating some of the flour at the same time.

Paperboard packaging poses similar problems. Paperboard is susceptible to water damage. Paperboard containers, although rigid, can also cause shipping problems. The rigid shape prevents a manufacturer from evacuating all of the air out of the container. Excess space is, therefore, taken up during shipping. The manufacturer cannot evacuate all of the air out of the container, thus, after the product eventually settles, there is an air pocket inside the cardboard container. The air pocket causes a portion of the cardboard container not to be supported by the product. The lack of support allows the cardboard to be more easily dented or crushed. A crushed wall of a cardboard container can cause a load of cardboard boxes to become unstable and either shift or collapse. Paperboard containers usually do not seal close, but are closed with a flap. The lack of a tight seal allows moisture, mold and insects to penetrate the container. In addition, cardboard containers are not transparent. This prevents a consumer from being able to view whether the container is full without having to open the container.

Plastic bags have long been used for dry powders having a generally larger particle size such as conventional granular sugar and ready-to-eat breakfast cereals. However, such bags generally include at least one opening such as a notch, pin hole or air channel to provide for air escape during packaging to provide an aspirated plastic bag. Also, the air escape hole allowed for shipment of the bags over mountains/high altitudes without causing rupture or bursting.

The presence of the pinhole to allow entrapped air to escape or vent, of course, renders the containers nonsuitable for use for containing liquids. Also, such air channels, holes, etc., undesirably allow insect contamination. Also, while such pinhole containing or perforated plastic bags are useful for particulate materials having a larger particle size, such as regular sugar, such perforated containers are unsuitable for use with fine powders such as baking flour. As the plastic bag is compressed during processing to expel any entrapped air, some amount of fine flour materials can be carried along with the air through the perforations. The expelled flour dust presents numerous sanitation negatives. More importantly, airborne flour dust is highly explosive and presents an extreme safety hazard.

Imperforate conventional plastic bag containers are not practical for fine particle baking products either. Imperforate bags that have air in them are not practical for shipping. They balloon up especially at higher altitudes, are unstable and take up additional precious cargo and storage space. In order to evacuate the air out of the bag, the air is either compressed out of the bag or it is vacuumed out of the bag prior to complete sealing. With fine particles, however, some of the particles get compressed out the bag or sucked out of the bag through the vacuum mechanism. Even if the manufacturer successfully evacuates air out of the plastic container, the consumer, however, normally does not possess a vacuum device or compression device to evacuate air after opening the bag. Consequently, the consumer, after the bag has been opened, has a bulky, ballooned-up bag.

Conventional containers for holding fine particle baking products are not desirable for shipping, storage or consumer use. A container for holding fine particles that can be sealed and resealed, but can easily have air evacuated out of it without removing the fine particles, is desired.

The present invention is a further improvement in the containers for storing fine particles disclosed in co-pending commonly assigned U.S. Ser. No. 09/135,319 (filed Aug. 7, 1998; attorney docket GMI 5144) entitled "Container For Storing Fine Particles" which is incorporated herein by reference. In the prior invention, plastic bags are provided with one or more macroscopic apertures or openings for exhausting of extrapped air. overlaying the apertures are air permeable but particulate impermeable layers, preferably mounted on the interior surface of the bag. Such a construction provides for desirable release of entrapped air while preventing escape of the contained particulate material or ingress by insects.

The present invention is also a further improvement in the improved containers for storing liquid or dry material such as flour, disclosed in co-pending commonly assigned U.S. Ser. No. 09/135,318 (filed Aug. 7, 1998, attorney docket GMI 5145) entitled "Container For Storing Fine Particles" which is incorporated hereby by reference. In that invention, a multiplicity of microscopic pores substitute for the single or smaller number of macroscopic openings or notches of the prior invention. In a further improvement, the previously required impermeable layer overlaying the macroscopic aperture can be eliminated. In addition to the structural differences in the present containers, the present invention provides important advantages in the ease and cost of fabrication.

The present invention provides further improvements in plastic bags for holding materials, especially those improved plastic bags for containing fine particles such as baking flour. The improvement comprises providing plastic bag containers for such materials having an external surface characterized by a coefficient of friction of about 0.4 to 0.5. Bags can be fabricated from film materials having the desired coefficient of friction. In other variations, bags can be treated by applying a topical coating to impart the desired characteristic.

SUMMARY OF THE INVENTION

In its article aspect, the present invention includes a container for holding fine particles comprising a main body having a pouch terminating in a principal opening. The pouch has an inside surface and an outside surface. Attached to the pouch adjacent the principal opening is a sealing mechanism. The sealing mechanism provides a sealed access point to the inside surface of the pouch through the principal opening. The containers further comprise a means for venting entrapped air while preventing loss or escape of the container material such as providing a multiplicity of microscopic pores in the pouch material, said pores having size dimension ranging from about 10 to 150 $\mu$m. The containers are fabricated from flexible film materials at least a major portion of which are characterized by an external surface having a coefficient of friction ranging from about 0.4 to 0.5.

In its method aspect, the present methods provide methods for making a container for holding fine particles. The methods comprise the steps of:

forming a sealed pouch from a flexible imperforate pouch material having a first major side face having an inside surface and an outside surface having a sealing mechanism disposed on the pouch adjacent the principal opening, the sealing mechanism closing the principal opening preventing migration of the material from the pouch; and wherein the pouch is free of openings having a dimension greater than 500 $\mu$m; and providing a multiplicity of microscopic pores in the pouch material, said pores having size dimension ranging from about 10 to 150 $\mu$m.

BRIEF DESCRIPTION 0F THE DRAWINGS

The above-mentioned objects and advantages can be more clearly seen by referring to the following detailed description and the drawings in which:

FIG. 1 is a perspective view of one preferred embodiment of the present invention partially cut away showing a container filled with particles;

DETAILED DESCRIPTION OF THE INVENTION

Figures 7, 8:
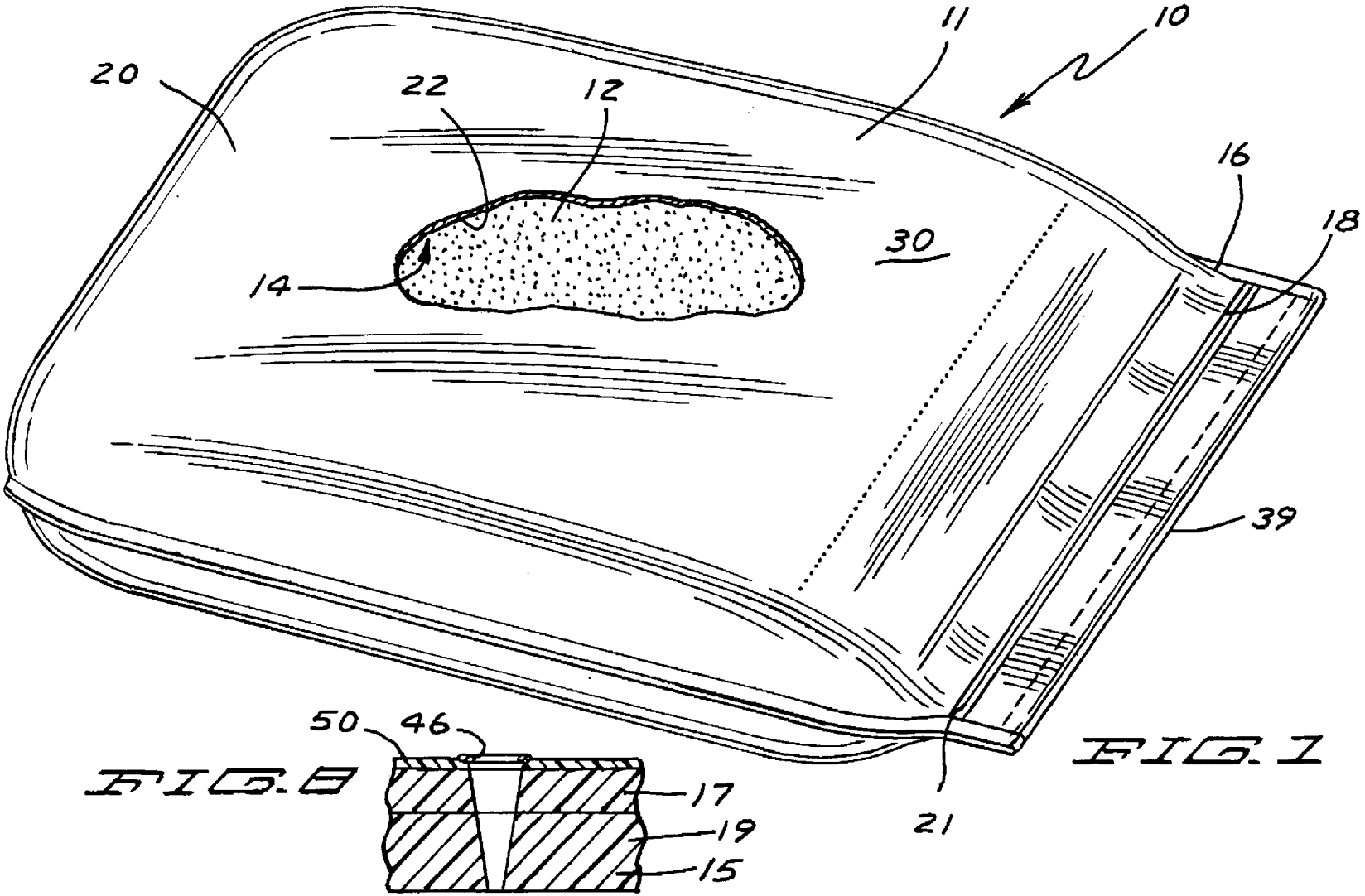
FIG. 7 is a micro photograph depicting microscopic pore feature of the present invention.
FIG. 8 is a highly enlarged sectional view greatly cut away similar to FIG. 4 showing a topical coating to provide the higher friction feature of the present invention.

For convenience, like numbers have been used to identify like parts.

Referring now to the drawings, FIG. 1 depicts a container 10 for storing fine particles 12 of the present invention. FIG. 1 shows container 10 lying on first major side 30 in an orientation suitable for stacking such as on a grocery shelf. FIG. 1 shows that container 10 includes a main body 11 for holding contained material such as fine particles 12, said main body 11 forming an interior region or a pouch 14 and terminating at a principal or top opening 16 sealed with a closure means such a sealing mechanism 18. Body 11 has a flexible outside surface 20 and, opposite outside surface 20, inside of pouch 14 an inside surface 22. Other than the defined microscopic scoring herein (as described below) container 10 is, especially in the preferred embodiments, imperforate and thus lacks the air discharge notch or other macroscopic apertures or openings (e.g., slits or cuts) conventional to bags known in the art.

While the present improved container 10 can be used for packing of a wide variety of, surprisingly, wet and/or variously sized dry materials, containers 10 find particular suitability for use for packing of fine dry particles 12. Fine particles include both edible materials such as foodstuffs and inedible materials. Illustrative edible materials include, for example, sugar (especially powdered sugar), flour, starch, salt, cocoa, baking powder, non-fat dry milk solids, protein powders, instant tea or coffee. These materials can be separate or admixed to form dry mixes such as for layer cakes, muffins, or other baked good or dry mixes for beverages, e.g., hot chocolate. Inedible materials could include a wide variety of fine particulate materials. Illustrative inedible fine materials include cement, dry adhesives, ground gypsum, diatomaceous earth or any other fine powder, especially those typically packaged in small quantities (0.1 to 5 kg). Containers 10 find particular suitability for "fine" dry materials, i.e., wherein at least a portion (e.g., 5%>) have a particle size of less than 500 micron (500 $\mu$m). Of course, containers 10 can be used to package larger sized materials, edible or inedible, e.g., rice, dried beans or lentils, ready-to-eat cereals, tea if desired. Containers 10 find particular suitability for use for all purpose baking flour (i.e., ground wheat flour) such as sold in one to five pound bags for consumer home use.

Preferably, pouch 14 comprises an imperforate, non-porous continuous flexible material 15 such as polypropylene and/or polyethylene plastic film. The flexible material 15 can be a single layer or can be laminated. The film material can be a polymer, copolymer or melt blends of various plastics.

Figure 4:
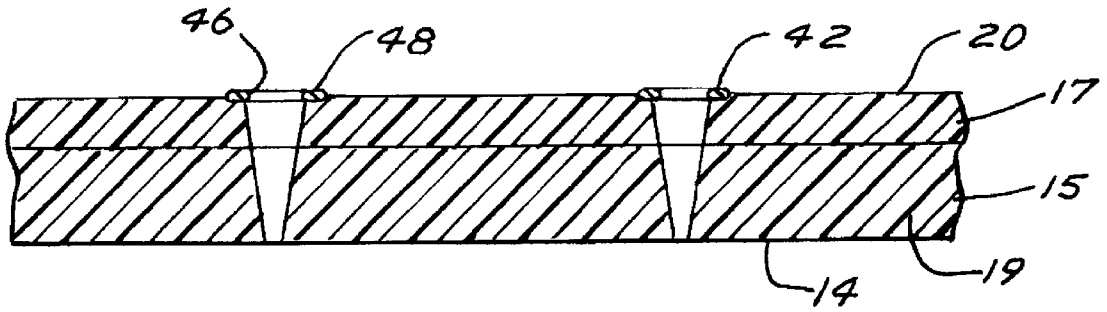
FIG. 4 is a highly enlarged sectional view greatly cut away taken along lines 4—4 of FIG. 3.

Referring now briefly to FIG. 4, in a preferred variation, a plastic film having an outside layer 17 of polypropylene (e.g., 15%) coextruded with and overlaying an interior or base layer 19 of polyethylene (e.g., 85%). In less preferred embodiments, the film material can be or include a metal foil and even cellulosic materials such as cellophane, glassine, greaseproof or even parchment paper.

The improved containers herein are further essentially characterized by an exterior surface, a major portion of which has an anti-slip feature such as having a coefficient of friction ("COF") ranging from 0.4 to 0.5. (The COF is measured according to the American Society for Testing Materials test protocol ASTM-D 189495 and as a ratio of the static or starting coefficient of friction ($\mu_s$) to the sliding coefficient of friction ($\mu_k$)). By "major portion" is meant at least 33% of one major surface. In preferred embodiments, both major surfaces 30 and 36 have the anti-slip feature. In more preferred embodiments, at least 50% of each major surface is supplied with the anti-slip feature.

Conveniently, the anti-slip feature can be supplied by an exterior or topical coating 50 onto the pouch plastic film material as seen in FIG. 8. For example, a very thin urethane coating, e.g., >1/10 mil (or >0.0001 inch; >3 microns) can be formed in known manner such as applying a solution thereof. The coating can be applied either to the film stock from which the containers are to be fabricated or after fabrication of the articles herein.

Containers having the desired anti-slip feature provide the additional advantage of ease of fabrication into multiple unit cases for distribution to retail or grocery stores. Importantly, on the grocery shelves, the stacked bags resist slipping and falling even when not disposed within conventional paperboard containers. Eliminating the conventional paperboard container not only takes up less retail shelf space but also significantly reduces the overall packaging costs.

Figure 6:
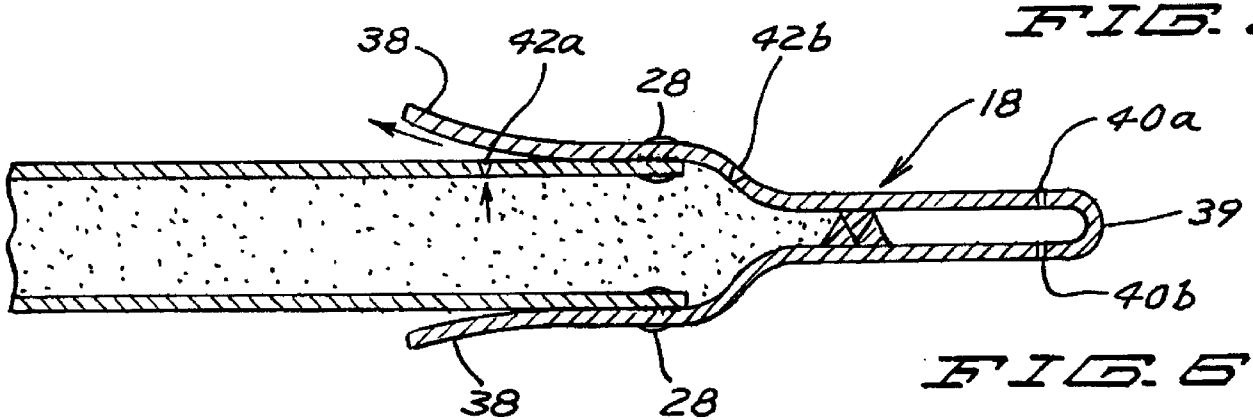
FIG. 6 is an enlarged sectional view greatly cut away showing a variation of one embodiment of the present invention showing fine particles with air removed from the pouch.
Figure 7:
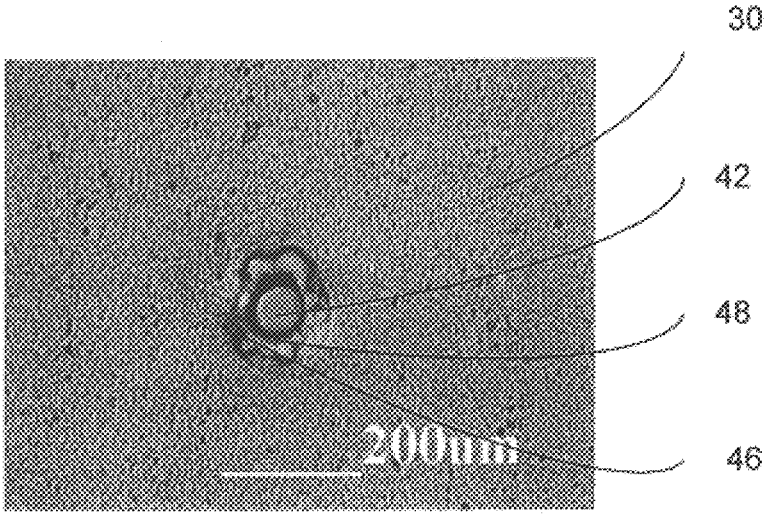

Referring once again to FIG. 1, sealing mechanism 18, in a closed position, prevents particles 12 from exiting pouch 14. When sealing mechanism 18 is closed, principal opening 16 is also closed. Sealing mechanism 18 preferably comprises at least a resealable sealing mechanism 21 such as the zipper mechanism found on Zip-Loc® storage bags. The resealable mechanisms 21 can either be formed in pouch 14 adjacent principal opening 16 or can be fabricated on separate strips of material that are secured to pouch 14 adjacent principal opening 16 by a seal 28, as best shown in FIG. 6. Seal 28 can be formed by heat, sonic welding, adhesives, pressure bonding or other known techniques.

Figure 2:
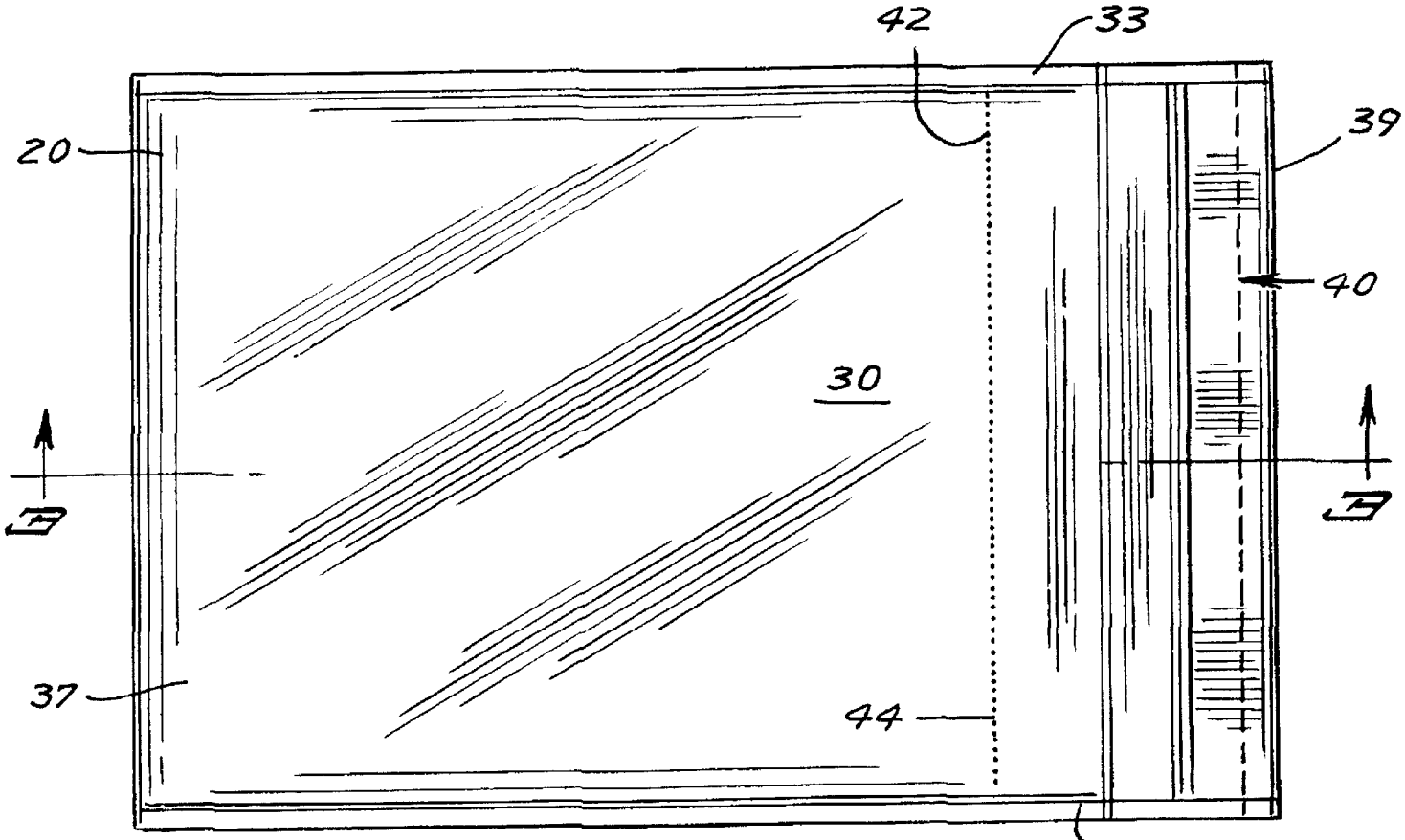
FIG. 2 is a plan view of one preferred embodiment of the present invention showing a container.

Referring now to FIG. 2, in one embodiment, main body 11 has a first and opposed second major surface 30 that are generally rectangular in shape. First and second major surfaces 30 can also be fabricated to have either regular shapes (e.g., geometric shapes) or irregular shapes. Body 11 is further defined by edges 32 that extend about the periphery of major surface 30 and can include side seals such as opposed fin seals 33 and 35 as well as lower curved edge 37 and upper curved edge 39. Other bag construction (e.g., lap seals in substitution for the depicted fin seals) and configurations can be used in substitution for the preferred embodiment depicted.

Figure 3:
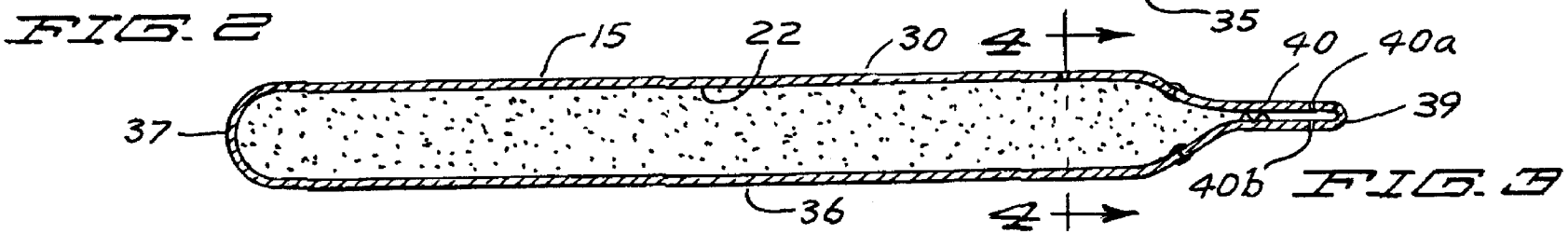
FIG. 3 is a sectional view of one embodiment of the container taken along lines 3—3 of FIG. 2.

FIG. 3 depicts that sealing mechanism 18 can be fabricated with one or more conventional score lines 40 to provide an easy open feature such as the matched opposed pair of upper and lower score lines 40*a* and 40*b* depicted. Such score lines 40 are well known in the art and can be fabricated using conventional techniques. Conventional score lines 40, however, are to be distinguished from the to-be-described microscopic pore feature that can be in the form of a particular scoring feature as described below. Conventional score lines 40 typically have 10 to 30 holes per linear inch, said holes having lengths on the order of 500 up to 5000 microns in length.

As depicted in FIGS. 2 and 3, conventional easy open score line 40 is in the form of at least one and preferably two transversely extending score lines positioned intermediate resealable feature 21 and curved edge 39. Articles comprising contained material 12 and containers 10 typically will be fabricated with resealable feature 21 being in an enclosed or engaged position to serve as a closure preventing the contained material 12 from escaping through the macroscopic holes that comprise score line 40.

FIG. 2 further shows that container 10 additionally essentially further includes a microscopic pore feature 42.

Conveniently, pore 42 can be in the form of one or more score lines such as the straight line 44 depicted. In one preferred variation, scoring line 44 extends transversely across the width of container 10.

However, the pore feature such as in the form of a scoring feature 44 can be positioned in any region intermediate edge 37 and edge 39. The pore feature can be in the form of a line, whether straight, angled, jagged, circular, curvilinear, continuous, intermittent or combinations thereof. While the microscopic pore feature such as score line 44 are depicted on the drawing for purposes of illustrating and describing the invention, the skilled artisan will appreciate that the pore sizes are of a size that microscopic pore score lines 44 may not be readily visually apparent to the naked eye. In other variations, pores 42 can be in the form of a random series of microscopic holes. In still other variations, the positioning and shape of microscopic pore feature 42 can be positioned such as to be obscured by exterior graphics on the package.

In less preferred embodiments, sealing mechanism 18 does not include a reclosure feature. In those embodiments, it is desirable not to provide the container with the easy open conventional scoring 40. In those embodiments, novel microscopic scoring 42 can be positioned on the bag at any location intermediate edge 37 and 39.

However, in those preferred embodiments wherein sealing mechanism 18 includes resealable seal or resealing feature 21 and conventional scoring 40, then the microscopic pore feature is preferably intermediate edge 37 and resealing feature 21 and in more preferred embodiments proximate to the resealing feature 21.

Reference now is made once again to FIG. 4. Microscopic pore feature 42 is in the nature of a multiplicity of microscopically sized pores ranging from about 10 to 150 microns in largest dimension, preferably about 30 to 70 $\mu$m. In preferred embodiments, pores are in form or circular apertures having a diameter within the above-given dimension range. Surprisingly, by fabricating such microscopically sized holes, air is allowed to escape while substantially preventing the escape of the finely contained particles. The preventing escape of fine particles is surprising in that while pulverant flour materials such as cereal flours that have an average particle size on the order of 50 microns will have a particle size distribution curve that includes some fraction of particles having a particle size of less than 1 micron. Notwithstanding that the microscopic pore size is on the order of 10 to 150 microns in diameter, surprisingly the flour acts to self seal the pores against escape of the flour while permitting escape of entrapped air.

Figure 5:
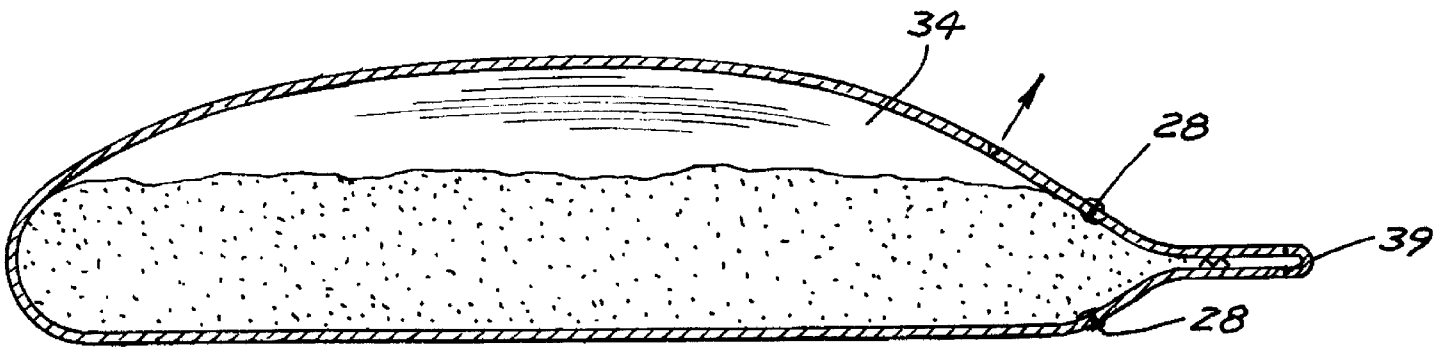
FIG. 5 is a sectional view of one embodiment of the present invention showing fine particles similar to FIG. 3 but showing air trapped in the pouch.

The number of microscopic pores is selected to effectively evacuate entrapped air in a reasonable period of time. For example, square shaped containers measuring approximately (25 cm)×(25 cm)×(5 cm) can hold about two kg of flour in about 4000 cubic centimeters of volume. During filling and fabricating, air can be entrapped within the bag as free headspace air (see FIG. 5). During filling and fabrication, the bags can be gently compressed to expel about 500 cubic centimeters of entrapped air as free headspace in about 10 seconds. To accomplish this evacuation of entrapped air, approximately 300 to 1000 microscopic pores, preferably about 300 to 800 holes are formed in the pouch plastic film material. In preferred variations, two score lines 44 each having about 25 to 30 pores per linear inch extend traversely across the width of face 30. Preferably, score lines of microscopic pores are the same upper major face 30.

Conventional packaging equipment and methods employing lasers can be used to provide the present microscopic pore feature. Such equipment and methods are, for example, described in U.S. Pat. No. 5,630,308 (entitled "Laser Scoring of Packaging Substrates" issued May 20, 1997 to A. Guckenberger) and U.S. Pat. No. 5,158,499 (entitled "Laser Scoring of Packaging Substrates" issued Oct. 27, 1992 to A. Guckenberger) each of which is incorporated herein by reference. However, the apparatus and techniques are modified to provide the laser pores or scoring herein essentially characterized by the pore diameter herein.

Reference is now made briefly to FIG. 7 which is a micro photograph of pouch packaging material exterior with a laser produced pore formed therein. In FIG. 7, it can be seen that pore 42 includes an aperture 46 ranging from about 30 to 100 $\mu$m, preferably 30 to 70 microns in diameter. Pore 42 can additionally include an annular ring 48 surrounding aperture 46.

Reference now is made briefly to FIG. 4. While not wishing to be bound by the proposed theory, it is speculated herein that laser scoring imparts a frusto conical shape to pore 42 that is larger on the outside such as at surface 20 than on the inside such as at interior surface 14 and may account for the phenomenon of allowing air escape while minimizing loss of the contained particulate flour notwithstanding that the pore diameter (30 to 100 $\mu$m) is substantially larger than the particle size of a portion of the flour having a particle size of less than 1 $\mu$m. Using higher laser power can form the pores to be less conical and more cylindrical.

As described above, during fabrication the present invention serves to allow evacuation of a substantial portion of the free headspace air entrapped in the bag 10 without escape of the flour particles to form a partially aspirated article. The skilled artisan will further appreciate that the present invention is not intended to remove the substantial majority of interstitial air between the flour particles. Indeed, for packaging flour, removal of interstitial air is undesirable. For example, vacuum packaging technology that is frequently used for packaging foodstuffs, for example meats, serves to evacuate not only the free headspace air but also interstitial air. While desirable in certain applications such as meat packaging, removal of interstitial air is undesirable for packaging certain pulverant foodstuffs such as flour. Removal of interstitial air from flour can adversely affect the flour handling properties. For example, flour that has been vacuum packaged can exhibit undesirable lumping. Also, such flour may require sifting prior to use in baking. It is an advantage of the present containers that flour lumping and compaction requiring sifting is minimized by removal only of a substantial portion of the free headspace air.

A further advantage of the present invention is that conventional commonly used vertical plastic bag forming equipment can be used to fill and fabricate the present improved containers. The laser pore scoring can be applied to the tubular film stock used to prepare the containers. In less preferred variations, the laser pore scoring can be applied after the bags have been formed and filled.

By locating the microscopic pore feature 42 near a body edge such as proximate resealing feature 21, trapped air 34 can also be expelled when a second container 10 is stacked on top of first container 10.

Although the microscopic pore air venting feature 42 herein has generally been described as being used for finely ground solid particulates baking products such as flour and powdered sugar, microscopic pore 42 and container 10, generally, are also applicable to liquid applications, especially using smaller pore diameter dimensions. Microscopic pores 42 only have to have a low enough porosity to allow trapped air 34 molecules to pass through, but not liquid molecules.

Reference now is made to FIG. 6 which depicts a variation of container 10 wherein sealing mechanism 18 is depicted as forming one or more flaps 38. In one embodiment of the present invention, flap 38 is formed into and attached to pouch 14 overlaying laser score line 42*a*. Flap 38 functions to minimize environmental factors such as moisture, air, odors, and microbes from entering into pouch 14 through laser scoring 42*a*. In the embodiment shown in FIG. 6, flap 38 flips open and away from laser scoring 42*a* when trapped air 34 is being squeezed out of pouch 14. After trapped air 34 is squeezed out of pouch 14, flap 38 flips back down to cover laser scoring 42*a*. Flap 38 can be exterior to the pouch as depicted in FIG. 6 or container 10 can be fabricated to have an interior flap 38.

Various embodiments of laser scoring configurations are possible. In embodiments where sealing mechanism 18 includes a resealable seal 21, trapped air 34 could be removed from container 10 by simple hand compression through laser scoring after each time sealing mechanism 18 is opened and closed.

Figure 9:
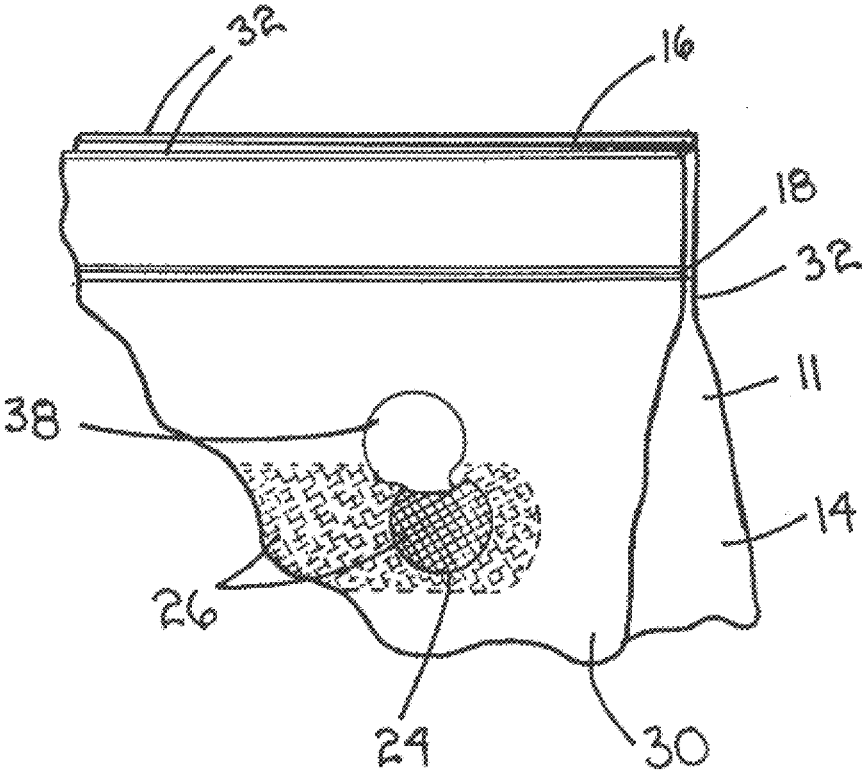
FIG. 9 is an enlarged, greatly cut-away sectional view of one embodiment of a flap and an exit port of the present invention.

Reference is now made to FIG. 9. While the invention has been described with particularity for the preferred embodiment wherein the air escape means comprises a multiplicity of microscopic pores, in a less preferred variation, the air escape means includes the combination of at least one macroscopic opening 24 in the pouch 14 and an air permeable particulate impermeable filter 26 overlaying the opening 24 and secured to the inner surface of the pouch 14. One or more macroscopic openings 24 can be made in various shapes, sizes and locations. As can be seen in FIG. 9, the air escape means can further include a flap 38 that overlays the exterior of opening 24.

Regardless of the particular construction of the air escape feature, a rectangular shaped first major surface 30 and second major surface 36 allows container 10 to lay flat on a counter. Several containers 10 could be stacked on top of each other. The added weight from each additional container 10 could be used to further compress lower containers 10. The flat configuration of container 10 would be safer for shipping. The lower profile would be less likely to shift in transport. The removal of trapped air 34 results in a smaller volume of space being taken up by container 10.

The lower profile and smaller space of container 10 would be more desirable to consumers. Container 10 would take up less space in the kitchen. A container 10, made of clear plastic in one embodiment, would allow a consumer to see how much material was in container 10 without having to open up sealing mechanism 18. At the same time, if desired, container can rest on curved edge 37 in an upward orientation both during use and storage.

The rectangular shape of first major surface 30 and second major surface 36, allows pouch 14 to be opened quite wide, permitting easy access of a scoop. Container 10 can be manufactured without folds, preventing particles 12 from getting caught and either spilling on the counter or remaining trapped in the bottom of container 10.

Container 10 in one embodiment is comprised of plastic that is less susceptible to insect and moisture penetration. Similarly, the plastic material prevents moisture in particles 12 from escaping from pouch 14. Producers would not have to overfill container 10 in order to compensate for moisture loss, because little moisture loss would occur. Some over filling can still be practiced to account for variations in full weight during packaging, however, if desired.

A further advantage for stored flour (e.g., wheat) in that by minimizing moisture loss, the baking properties are desirably maintained.

Having illustrated and described the principles of the present invention in the preferred embodiments it will be apparent to those skilled in the art that the invention can be modified in arrangement and detail without departing from such principles. We claim all modifications coming within the scope and spirit of the following claims.

It is claimed:

1. A container for holding a contained material, comprising:

a main body, the main body forming a pouch terminating in at least one principal opening;

the pouch fabricated from a flexible imperforate pouch material such that the resultant pouch has a first major side face having an inside surface and an outside surface;

a sealing mechanism disposed on the pouch adjacent the principal opening, the sealing mechanism closing the principal opening preventing migration of the material from the pouch;

wherein at least a portion of the pouch material has an anti-slip surface having an external coefficient of friction ranging from about 0.4 to 0.5.

2. The container of claim 1 additionally comprising means for allowing escape of air from the pouch while preventing escape of the contained material.

3. The container of claim 2 wherein the air escape means includes at least one macroscopic opening in the pouch and an air permeable particulate impermeable filter overlaying the opening and secured to the pouch.

4. The container of claim 2 wherein the air escape means comprises a multiplicity of microscopic pores at least a portion of which extend through the pouch material from the outside surface, said pores having an outside surface dimension ranging from about 10 to 150 $\mu$m.

5. The container of claim 4 wherein at least a portion of the sealing mechanism is resealable.

6. The container of claim 5 wherein the sealing mechanism comprises a permanent seal and a resealable seal adjacent the permanent seal.

7. The container of claim 6 wherein the pouch has a second major surface opposed from and spaced apart from the first major surface and wherein the majority of microscopic pores are in the first major surface.

8. The container of claim 7 wherein the arrangement of microscopic pores is in the form of at least one line.

9. The container of claim 8 wherein the line arrangement of microscopic pores is straight.

10. The container of claim 7 wherein the number of microscopic pores ranges from about 300 to 800.

11. The container of claim 10 wherein the pores are formed by laser scoring.

12. The container of claim 11 wherein the microscopic pores that are formed by laser scoring are frusto conical in shape.

13. The container of claim 11 wherein at least one line of pores formed by laser scoring are proximate the resealing feature.

14. The container of claim 13 further including at least one flap proximate the resealing feature.

15. The container of claim 14 wherein the flap overlays the pore line proximate the resealing feature.

16. The container of claim 5 wherein the plastic film pouch material comprises a coextruded film, comprising a plurality of superimposed layers which comprise at least a first inner layer of high density polyethylene and a second outer layer of high density polypropylene.

17. The container of claim 16 wherein the resealing feature includes a zipper in a closed position.

18. The container of claim 17 wherein at least a portion of the pores has an exterior dimension of about 30 to 70 $\mu$m.

19. The container of claim 18 wherein the sealing mechanism includes at least one easy open score line intermediate the resealing feature and the permanent seal.

20. The container of claim 6 additionally comprising a quantity of contained material disposed within the pouch.

21. The container of claim 20 wherein the contained material is a dry particulate.

22. The container of claim 21 wherein the dry particulate comprises an edible foodstuff.

23. The container of claim 22 wherein at least a portion of the edible foodstuff is in the form of a powder.

24. The container of claim 22 wherein the edible foodstuff includes a member selected from the group consisting of flour, sugar, starch, cocoa, salt, baking powder, non-fat dry milk solids, and mixtures thereof.

25. The container of claim 2 wherein the anti-slip surface comprises a topical urethane coating overlying the external surface of the pouch material.

26. The container of claim 25 wherein at least a majority of the pouch material has an external anti-slip surface.

27. The container of claim 26 wherein the anti-slip surface is discontinuous.

28. The container of claim 27 wherein the body includes a second major face opposed to the first major face and wherein each major face includes an anti-slip surface portion.

29. The container of claim 3 wherein the anti-slip surface comprises a topical urethane coating overlying the external surface of the pouch material.

30. The container of claim 29 wherein at least a majority of the pouch material has an external anti-slip surface.

31. The container of claim 30 wherein the anti-slip surface is discontinuous.

32. The container of claim 31 wherein the body includes a second major face opposed to the first major face and wherein each major face includes an anti-slip surface portion.

33. The container of claim 4 wherein the anti-slip surface comprises a topical urethane coating overlying the external surface of the pouch material.

34. The container of claim 33 wherein at least a majority of the pouch material has an external anti-slip surface.

35. A method of making a container for holding fine particles comprising the steps of:

forming a sealed pouch from a flexible imperforate pouch material having a first major side face having an inside surface and an outside surface having a sealing mechanism disposed on the pouch adjacent a principal opening, the sealing mechanism closing the principal opening preventing migration of the material from the pouch; and wherein the pouch includes means for allowing air to escape from the pouch while preventing escape of the contained material, and providing an anti-slip surface to at least a portion of the outside surface of the pouch having an external coefficient of friction ranging from about 0.4 to about 0.5.

36. The method of claim 35 wherein the air escape means includes at least one macroscopic opening in the pouch and an air permeable particulate impermeable filter overlaying the opening and secured to the pouch.

37. The method of claim 35 wherein the air escape means comprises a multiplicity of microscopic pores at least a portion of which extend through the pouch material from the outside surface, said pores having an outside surface dimension ranging from about 10 to 150 $\mu$m.

38. The method of claim 37 wherein the providing the anti-slip surface step is practiced by applying an anti-slip coating to the pouch material prior to the forming the pouch step.

39. The method of claim 37 further comprising the steps of:

introducing a fill material into the pouch whereby air is entrapped within the sealed pouch; and compressing the pouch to expel entrapped air through the pores to form an aspirated container.

40. The method of claim 39 wherein the fill material is an edible dry particulate having an average particle size of less than 100 microns.

41. The method of claim 40 wherein the fill material is an edible foodstuff.

42. The method of claim 41 wherein the edible foodstuff includes a member selected from the group consisting of flour, sugar, starch, cocoa, salt, baking powder, non-fat dry milk solids, and mixtures thereof.

43. The container of claim 3 wherein the multiplicity of microscopic pores ranges from about 300 to 1000.

44. The container of claim 3 wherein the pouch material comprises a plastic film.

45. The method of claim 39 wherein the sealing mechanism includes a means for resealing the pouch.

46. The method of claim 45 wherein the resealing the pouch includes a zip lock strip extending at least a portion across the principal opening.

* * * * *